US006910241B2

(12) United States Patent
Wang

(10) Patent No.: US 6,910,241 B2
(45) Date of Patent: Jun. 28, 2005

(54) BARBECUE BASTING BRUSH WITH A CHANGEABLE BRUSH HEAD

(76) Inventor: Yu-Tzu Wang, 21F-3, No. 189, Sec. 2, Keelung Rd., Taipei (TW), 110

( * ) Notice: Subject to any disclaimer, the term of this patent is extended or adjusted under 35 U.S.C. 154(b) by 275 days.

(21) Appl. No.: 10/413,361

(22) Filed: Apr. 15, 2003

(65) Prior Publication Data

US 2004/0205917 A1 Oct. 21, 2004

(51) Int. Cl.[7] ..... A46B 7/00
(52) U.S. Cl. ..... 15/176.6; 15/176.1; 15/202
(58) Field of Search ..... 15/176.1, 176.4, 15/176.5, 176.6, 202

(56) References Cited

U.S. PATENT DOCUMENTS 4,494,268 A * 1/1985 Chu ..... 15/176.1
6,237,183 B1 * 5/2001 Fischer ..... 15/167.1

* cited by examiner

*Primary Examiner*—Randall Chin
(74) *Attorney, Agent, or Firm*—Bacon & Thomas PLLC

(57) ABSTRACT

A barbecue basting brush with a changeable brush head consists of an elastic brush head and a handle that are fastenable and detachable with each other. The brush head has a coupling section which has one end forming a notch on one side and another side forming an elastic latch tongue. The handle has one end forming an annular hub to couple with the coupling section of the brush head. The annular hub and the stem of the handle form a juncture which has a retaining block formed on the inner side of the annular hub. The brush head may be inserted into the annular hub from the end where the notch is located. The plane of the notch is in contact with the plane of the handle where the retaining block is located to form a latched bucking to allow the brush head to be inserted into the annular hub for a selected depth and anchored. By depressing a latch section of the elastic latch tongue of the brush head that extends outside the rear end of the annular hub after having coupled, the latched condition on the annular hub may be released to easily remove the brush head from the annular hub.

6 Claims, 5 Drawing Sheets

BARBECUE BASTING BRUSH WITH A CHANGEABLE BRUSH HEAD

BACKGROUND OF THE INVENTION

1. Field of the Invention

The invention relates to a barbecue basting brush with a changeable brush head and particularly to a barbecue basting brush that has a latching means located on the brush head and the handle end to allow the brush head to be movably coupled on the handle.

2. Description of the Prior Art

Cookout or barbecue indoors or outdoors is a popular leisure activity for many people on holidays. Many tools are required in barbecue activity, such as barbecue grills, spatulas, and basting brushes. The basting brush is a consumable supply and must be thrown away once the bristles are stuck with barbecue paste or lose hairs. While some high quality basting brushes are made from higher quality bristles and may last longer, they still have to be replaced after having been used for a period of time. The basting brush is discarded mainly because of the bristles have been frayed or damaged. But the handle still is useable. To throw away the entire basting brush because of the bristles not only is a waste, it also creates an environmental pollution problem. Therefore to develop a basting brush with changeable bristles not only has market requirements also is a better way to protect earth resources.

SUMMARY OF THE INVENTION

The primary object of the invention is to provide a barbecue basting brush that has a detachable brush head and handle so that the brush head may be replaced individually when damaged without throwing away the handle which is still usable to overcome the problem of the conventional barbecue basting brushes that have to discard the entire brushes and result in waste and environmental pollution.

The basting brush according to the invention includes a brush head and a handle that are detachable and may be coupled as desired. The brush head includes a bristle section and a coupling section to form a permanent bonding. The coupling section is an annular sleeve with a distal end of one side forming a notch and the center end of another side forming a latch tongue. The handle is an elongated stem including a handgrip and a stem fastening together. The stem has a distal end forming an annular hub which has a retaining block located on an inner side of the juncture of the annular hub and the stem. The coupling section may be inserted into and latched on the annular hub to allow the brush head and the handle to couple together. During coupling, the plane where the notch of the coupling section located is in contact with the plane of the retaining block of the annular hub so that the notch and the retaining block are coupled with each other to allow the brush head to be confined in the annular hub in a desired depth. In addition, when the brush head and the handle are coupled, the latch tongue of the coupling section of the brush head has a hook section on the tail end to latch on a side edge of the annular hub. The elastic force of the latch tongue and the coupling force of the tail end of the latch tongue enable the coupling section to be securely latched in the annular hub so that the brush head does not breaking away during dispensing barbecue paste. Moreover, the latch tongue also may facilitate detaching operation. By depressing the tail end of the latch tongue towards the notch direction, the hook section may be moved away from the side edge of the annular hub, then the brush head may be removed from the annular hub.

By means of the construction set forth above, the detachable brush head may be replaced as desired and save the cost of replacing the entire set of barbecue basting brush. It also conforms to environmental protection requirements.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
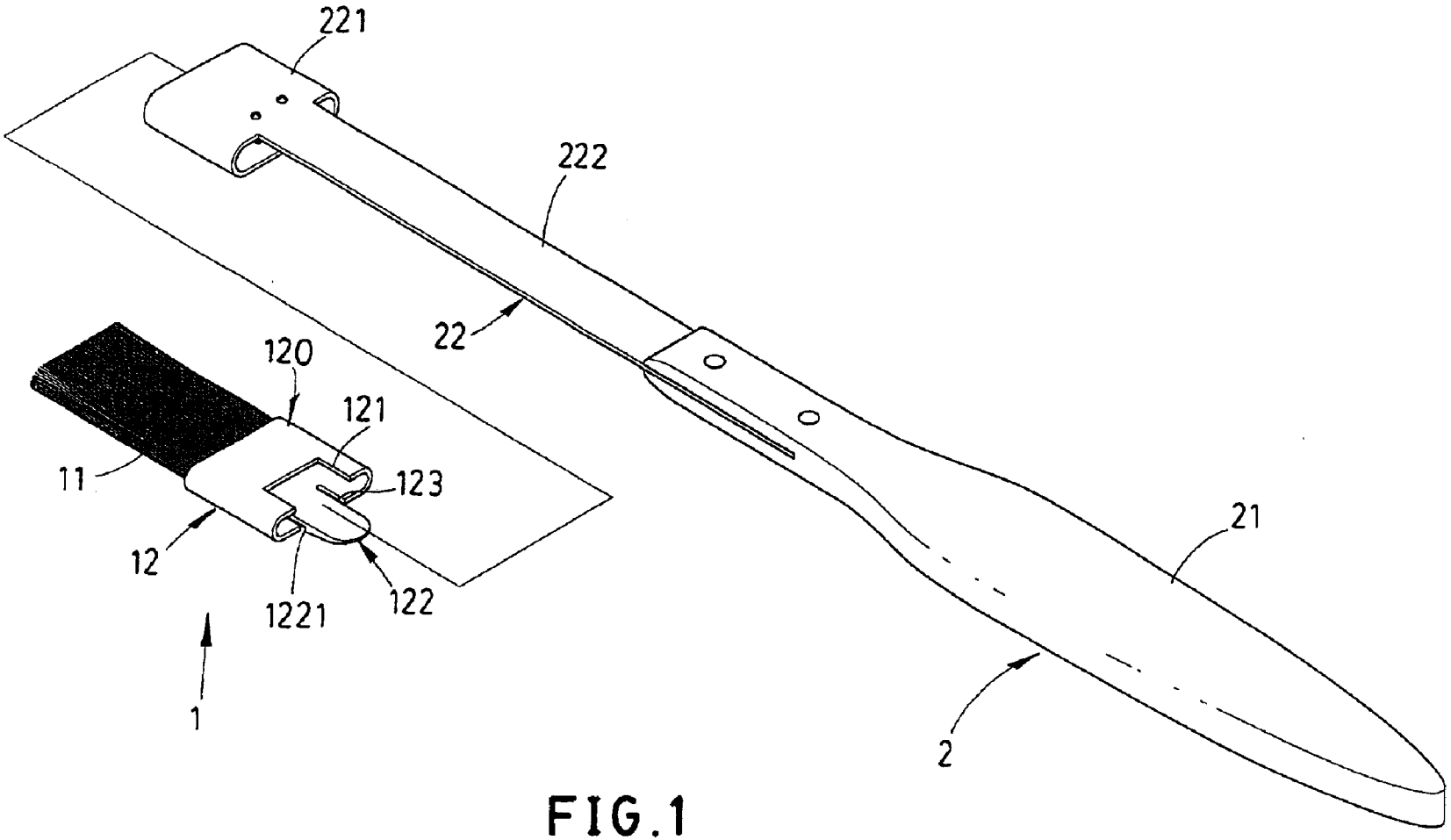
FIGS. 1 and 2 are front and rear perspective views of the invention.
Figure 2:
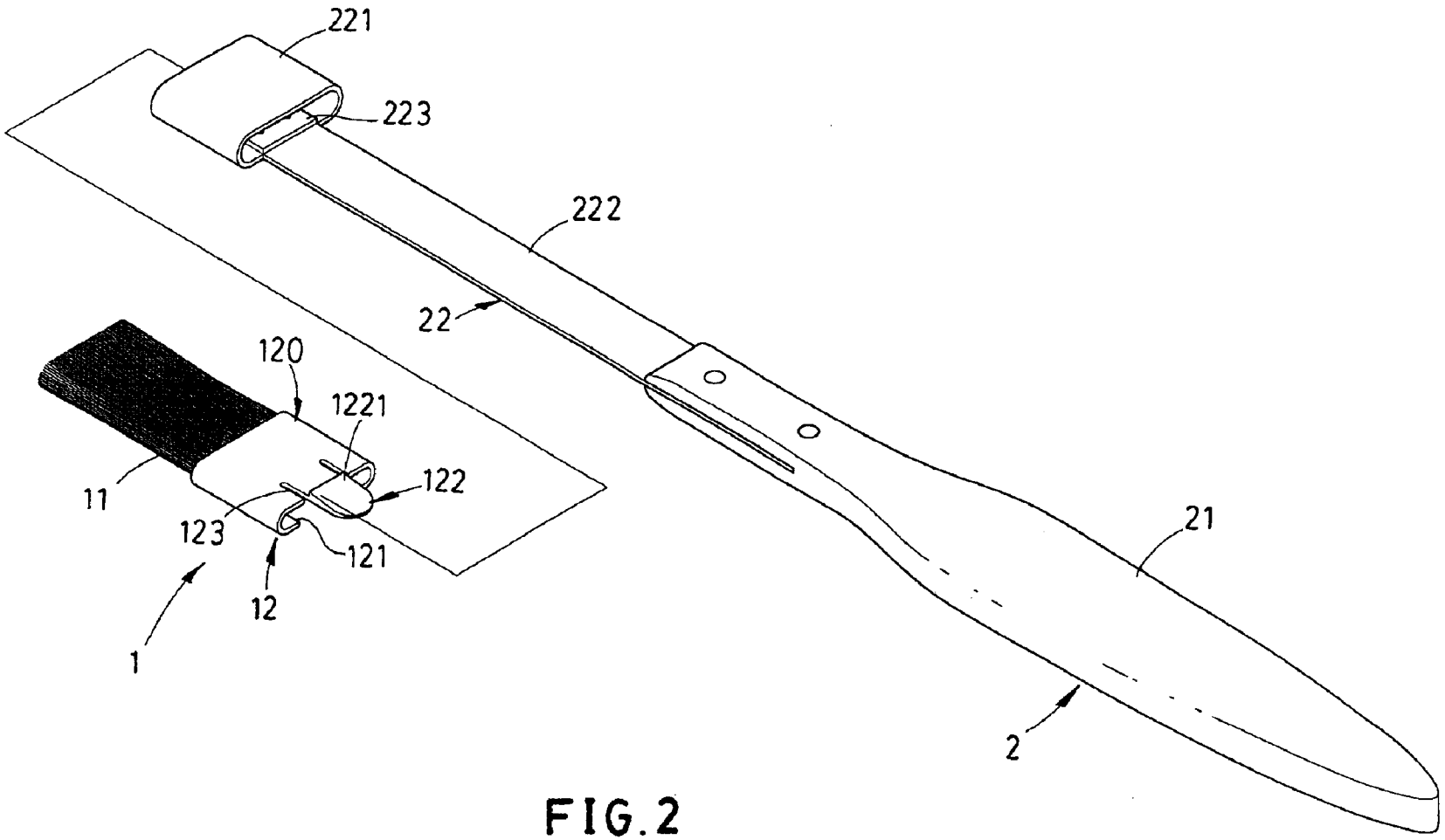

Referring to FIGS. 1 and 2, the barbecue basting brush according to the invention includes a bush head 1 and a handle 2. The brush head 1 includes bristles 11 and a coupling section 12 permanently bonding together. The coupling section 12 is a hollow annular sleeve 120 which has one end forming a notch 121 opposite to another end bonding the bristles. The annular sleeve 120 has a protrusive latch tongue 122 on another side opposing the notch. There are two slots 123 formed on the juncture of the latch tongue 122 and the annular sleeve 120 to allow the latch tongue 122 to become an elastic section movable up and down on the annular sleeve 120. The latch tongue 122 has one side forming a bulged hook section 1221. The handle 2 has a handgrip 21 which has one end fastening to a stem 22. The stem has a distal end forming an annular hub 221 which has a retaining block 223 located on an inner side connecting to a shank 222.

Figure 3:
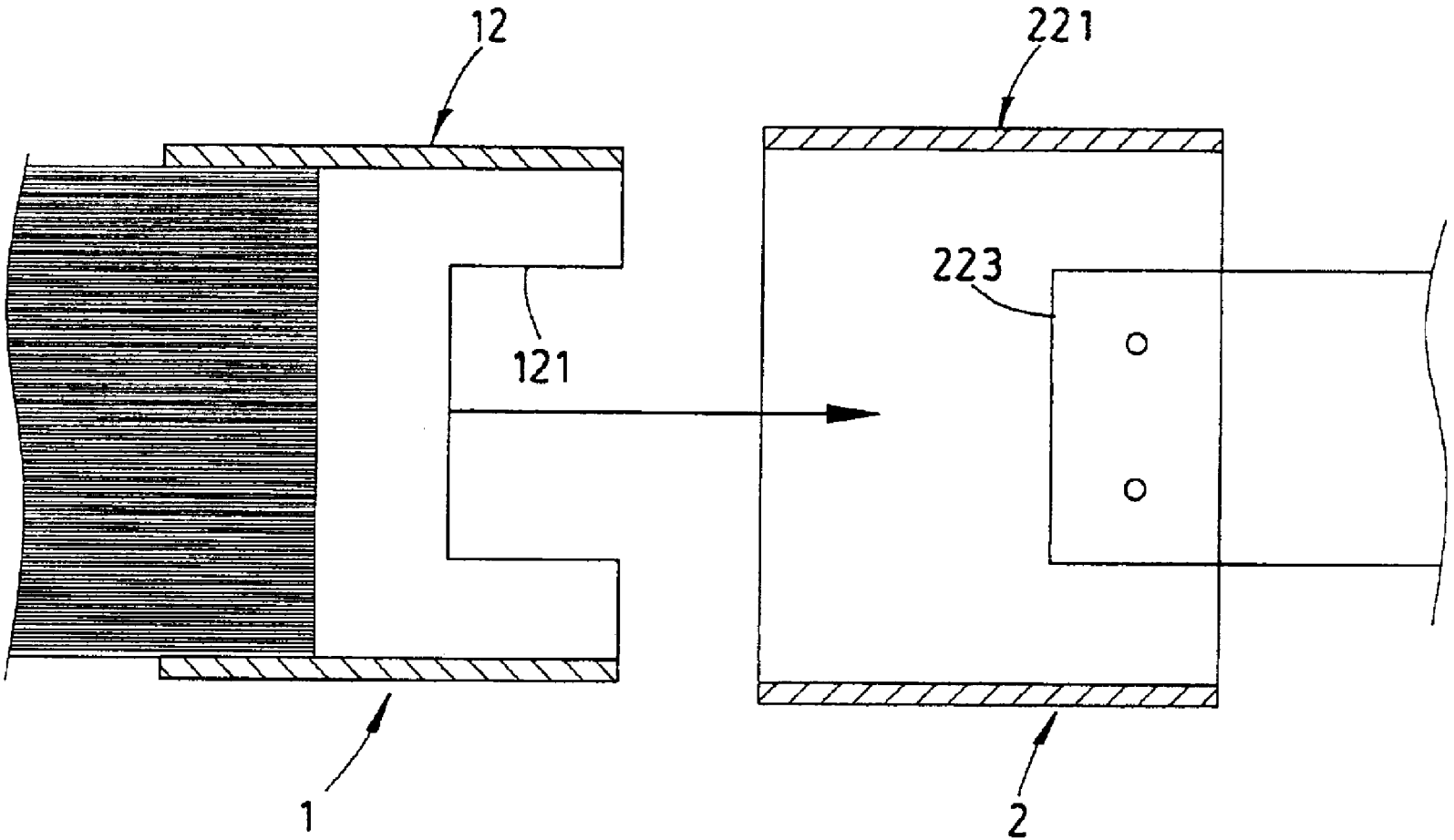
FIGS. 3, 4 and 5 are schematic views of the invention in various operating conditions.
Figure 4:
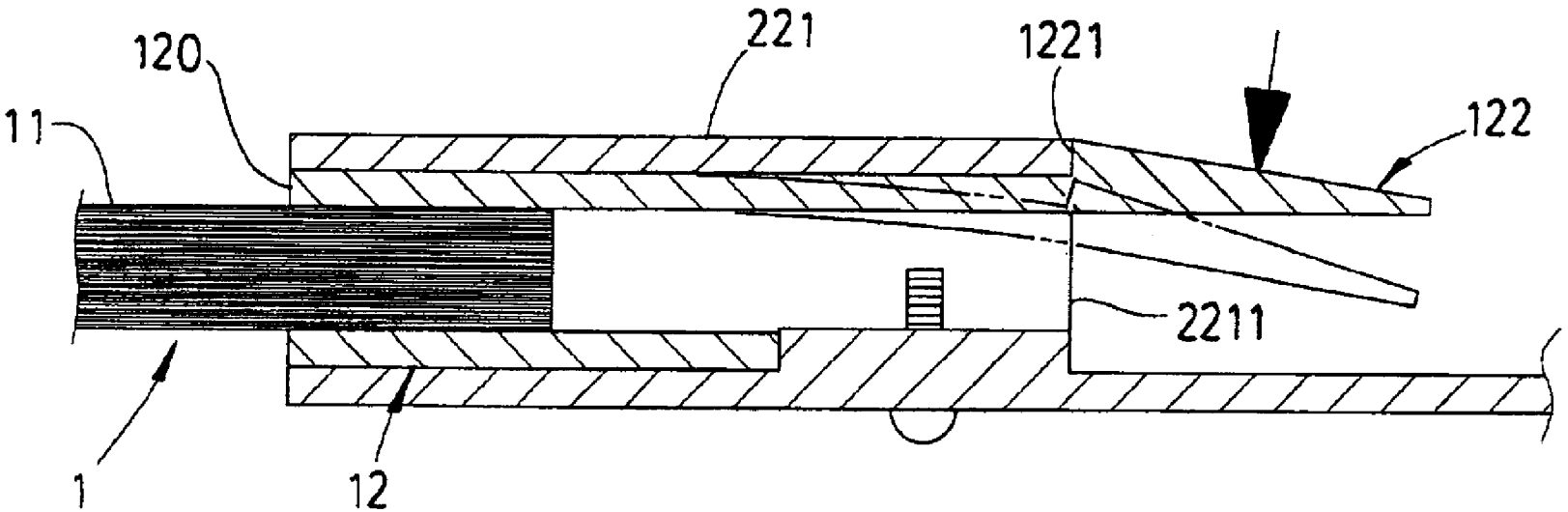
Figure 5:
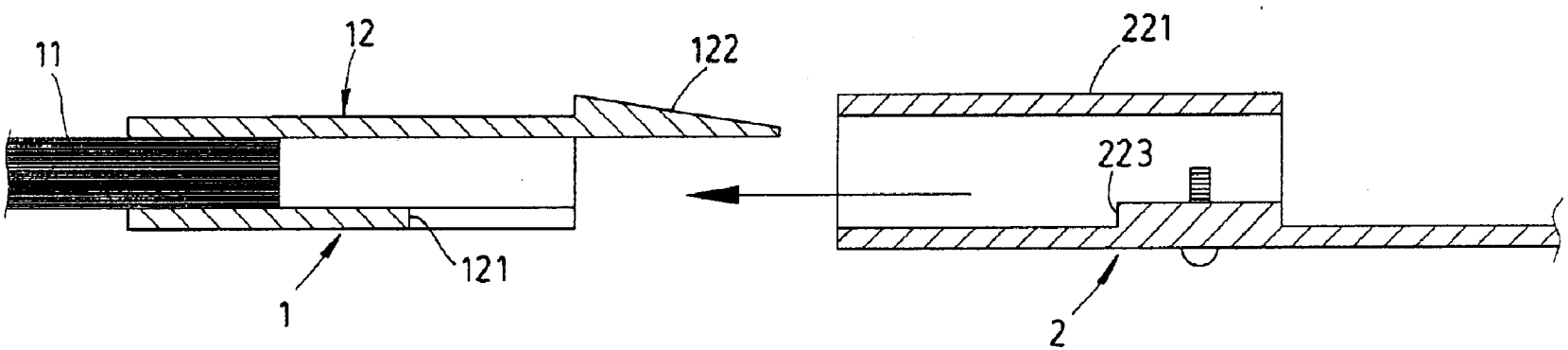

Referring to FIGS. 3, 4 and 5 for assembly and detaching of the brush head 1 and the handle 2, first, insert the coupling section 12 of the brush head 1 into the annular hub 221 of the handle 2, with the plane where the notch 121 of the coupling section 12 is located in contact with the plane where the retaining block 223 of the annular hub 221 is located (as shown in FIG. 3). Thus when the coupling section 12 is inserted into the annular hub 221 for a selected depth, the notch 121 and the retaining block 223 are coupled with each other to form a positioning effect. After the coupling section 12 is positioned in the annular hub 221, the latch tongue 122 is latched on a remote side edge of the annular hub 221. The hook section 1221 at the tail end of the latch tongue 122 engages with a lateral side 2211 of the annular hub 221 to prevent the brush head 1 from escaping from the annular hub (as shown in FIG. 4). In such a structure, because of the slots 123 (not shown in the drawings) formed between the latch tongue 122 and the annular sleeve 120, the latch tongue 122 has elasticity like an elastic plate. Hence with the coupling section 12 having a smaller outer dimension than the inner dimension of the annular hub 221, the coupling section 12 may be inserted into the annular hub 221 and extended outwards to form a bucking effect so that the coupling section 12 may be coupled with the annular hub 221 tightly. The elastic latch tongue 122 also may facilitate removing of the brush head 1 from the annular hub 221. By depressing the tail end of the latch tongue 122 exposed outside the annular hub 221 (referring to FIG. 4), latching between the hook section 1221 and the side edge of the annular hub 221 may be disengaged in the direction of the notch 121, then the brush head 1 may be pushed out from the annular hub 221 in the direction of the bristles 11 (as shown in FIG. 5). During removing the brush head, user's hand does not touch the bristles 11, thus may be free from smearing of the barbecue paste attached to the bristles 11.

I claim:

1. A barbecue basting brush having a changeable brush head comprising a brush head and a handle fastenable and detachable with each other, the brush head including a bristle section and a coupling section bonding together, the handle including a straight handgrip fastening to a stem on one end thereof;

wherein the coupling section of the brush head has a distal end opposing one end which bonds bristles, the distal end having one side formed a notch and another side formed a protrusive latch tongue;

wherein the handle has an annular hub at a distal end opposite to the handgrip, the annular hub and a shank of the stem forming a juncture on an inner side of the annular hub that has a retaining block formed thereon;

wherein the coupling section of the brush head is insertable into the annular hub of the handle to form the barbecue basting brush.

2. The barbecue basting brush of claim 1, wherein the latch tongue and the coupling section of the brush head are spaced by a slot to allow the latch tongue and the coupling section to maintain an elastic movable condition.

3. The barbecue basting brush of claim 1, wherein the latch tongue of the brush head has a hook section adjacent to the distal end.

4. The barbecue basting brush of claim 1, wherein the side of the brush head that forms the notch is in contact with the surface of the annular hub of the handle that has the retaining block located thereon.

5. The barbecue basting brush of claim 4, wherein the notch of the brush head is bucking against the retaining block of the handle to allow the brush head to be coupled and anchored in the annular hub of the handle.

6. The barbecue basting brush of claim 1, wherein the coupling section of the brush head is an annular sleeve.

* * * * *